United States Patent [19]

Rein

[11] Patent Number: 4,977,548

[45] Date of Patent: Dec. 11, 1990

[54] CLOCK SECURITY DEVICE

[75] Inventor: Gary Rein, Bronxville, N.Y.

[73] Assignee: Brown & Williamson Tobacco Corporation, Louisville, Ky.

[21] Appl. No.: 513,398

[22] Filed: Apr. 23, 1990

[51] Int. Cl.[5] ..... G04B 47/00; G04B 19/06

[52] U.S. Cl. ..... 368/10; 368/232; 368/278

[58] Field of Search ..... 368/223, 228, 232, 234, 368/276, 278, 10, 79, 296

[56] References Cited

U.S. PATENT DOCUMENTS 2,506,134 5/1950 Burchell ..... 368/232

4,177,634 12/1979 Calienes ..... 368/232

*Primary Examiner*—Vit W. Miska

*Attorney, Agent, or Firm*—Charles G. Lamb

[57] ABSTRACT

A clock security device to be hung on a wall of a facility such as, for example, a store. The clock face has a convex mirrored surface which provides reflected panoramic view of the facility. The clock security device also includes a mounting bracket which provides for the mounting of the clock security device on the wall with the concave mirrored surface at different positions from parallel to the wall to tilted downwardly at different selected angles to the wall.

7 Claims, 3 Drawing Sheets

CLOCK SECURITY DEVICE

BACKGROUND OF THE INVENTION

1. Field of the Invention

The present invention is directed to mirror type security devices used for surveillance, and more particularly such a mirror-type surveillance mirror disguised as a clock.

2. BACKGROUND OF THE INVENTION

Security mirrors having a convex reflective sueface for surveillance of stores and the like are known. Examples can be seen in any number and types of stores, for example, grocery stores.

In addition, clocks having convex faces are also known. Examples of such clocks are shown in U.S. Design Pat. No. 98,089 issued Jan. 7, 1936 A. S. Rittenberg; U.S. Pat. No. D. 160,791, issued Mar. 23, 1937 to A. H. Rusch: U.S. Pat. No. D. 160,434, issued Oct. 10, 1950 M. E. Schlenker; U.S. Pat. No. D. 215,466, issued Sept. 30, 1969 H. B. Jones; and, U.S. Pat. No. 2,506,134 issued May 2, 1950 to F. Burchell.

SUMMARY OF THE INVENTION

The present invention provides a clock security device which has a clock face having a convex mirrored surface for reflecting a panoramic view of a facility or room in which it is installed.

More particularly, the present invention provides a clock security device to be hung on a wall of a facility comprising a clock face having a convex mirrired surface for reflecting a panoramic view of the facility in which the clock security device is installed, and means for mounting the device on the wall with the convex mirrired surface at different selected positions relative to the wall from parallel to the wall to tilted downwardly at different selected angles to the wall.

BRIEF DESCRIPTION OF THE DRAWINGS

A better understanding of the invention will be had upon reference to the following description in conjunction with the accompanying drawings wherein.

DETAILED DESCRIPTION OF THE PREFERRED EMBODIMENTS

Figure 1:
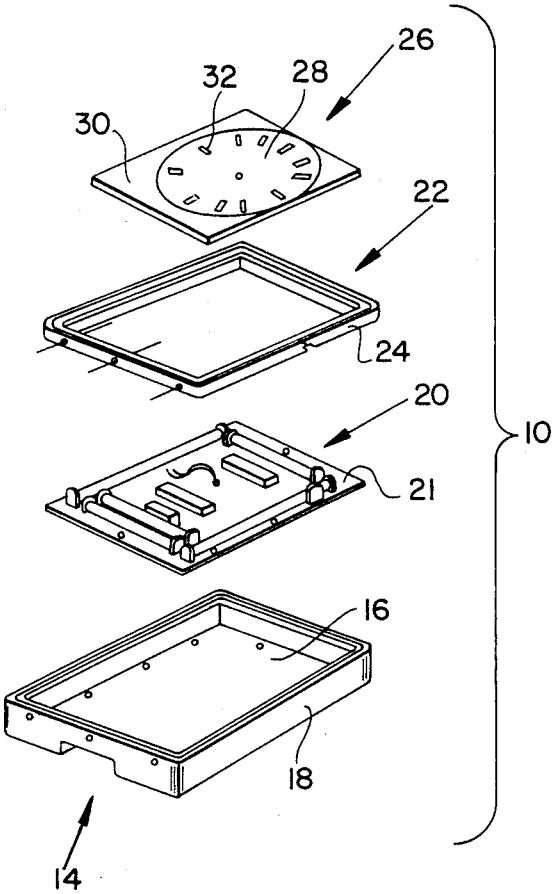
FIG. 1 is an exploded view of one embodiment of a clock security device of the present invention.

With reference to FIGS. 1–6, there os shown a clock security device generally denoted as the numeral 10, to be hung on a wall 12 of a facility or room to provide for surveillance of the area for security purposes.

The clock security device 10 includes a clock having a housing 14 having a back wall 16 and a peripheral side wall 18 projecting outwardly from the back wall 16. Illumination means 20 is located inside the housing 14. The illumination means 20 is shown as including a plurality of lamps, such as fluorescent bulbs, including appropriate electrical fixturing (not shown), mounted to a support panel 21 laid over the back wall 16 of the housing 14. A translucent light diffusion panel 22 is positioned over the opening of the housing 14 defined by the peripheral side wall 18 generally parallel to and spaced from the housing back wall 16 so that illumination means 20 is covered by the front panel 22. The front panel 22 also includes an integral peripheral raised border 24 which is disposed adjacent to the peripheral side wall 18 of the housing 14. A face panel 28 is installed over the light diffusion panel 22 inside of the perpheral border 26. The face panel 26 includes a convex clock face 28 and a planer flange 30 extending circumferentially outwardly from the convex clock face 28. The concave clock face 28 includes indicia 32, such as hour numerals, an hour hand 34, and a minute hand 36. A time keeping mechanism 37 is mounted to the concave side of the clock face 28 and is operatively connected to the hour and minute hands. The convex face 28 is fabricated of a mirrored or reflective material for reflecting a panoramic field of view of the area. The planar flange 30 can also be fabricated of a mirrored or reflective material or translucent material. In addition, the indicia 32 on the convex clock face 28 is translucent material. Light from the illumination means 20 shines or emits through the translucent material of the indicia 32 and through the border 24 of the front panel 22.

Figure 2:
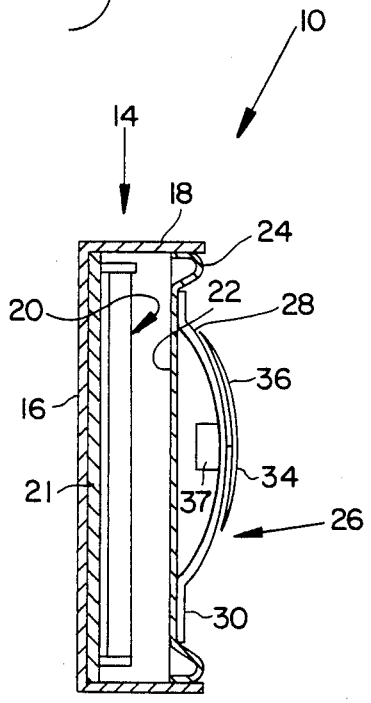
FIG. 2 is a cross-sectional side view of the clock security device of FIG. 1.
Figure 3:
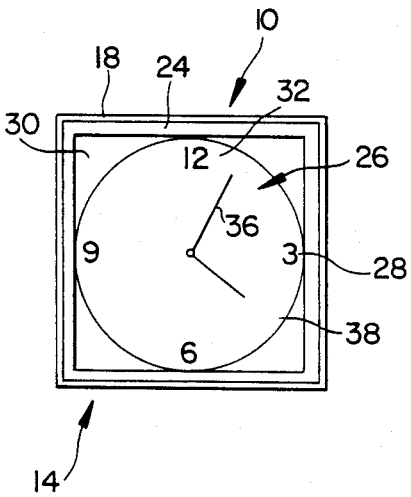
FIG. 3 is a front view of one embodiment of the clock security device of the invention.

The clock security device 10 further includes mounting means, generally denoted as the numeral 38, for mounting the clock security device 10 to the wall to position the convex clock face 28 at different selected positions relative to the wall 12 between parallel to the wall 12 (as seen in FIG. 2) to tilted downwardly at different selected angles to the wall (as seen in FIG. 3).

Figure 4:
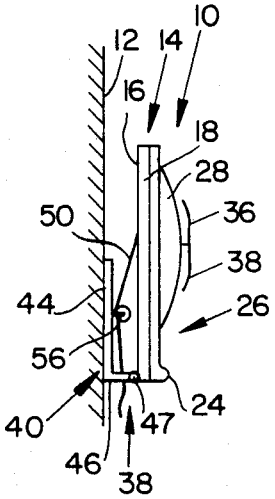
FIG. 4 is a side view of the clock security device of FIG. 1 in one postion relative to the wall upon which it is mounted.

With reference to FIGS. 2–4, the wall mounting means 38 comprises a wall mounting bracket 40 which is mounted on the wall 12 and is pivotally connected to the bottom edge of the back wall 16 of the housing 14 by pivot means 47, such as a hing. Toward this objective, the wall mounting bracket 40 is shown as being L-shaped in side view with its verical flange 44 to be disposed against the wall 12 and a horizontal flange 46 integral with and projecting at 90° to the vertical flange 44. The mounting means 38 further includes adjustable means 48 interconnecting the housing back wall 16 to the mounting bracket 40 at differect downwardly tilted angles about the pivot axis of the hinge 42 to provide for changing or adjusting the vertical field of view reflected in the convex clock face 28.

The adjustable interconnecting means 48 is shown as including a tether 50, such as a chain, having one end structurally associated with the housing back wall 16 and structurally associated at its other end with the wall mounting bracket 40. The adjustable interconnecting means 48 further includes tether length adjusting means 52 for adjusting the length of one tether extending between the wall mounting means 22 and the housing back wall 16. The tether length adjusting means 52 engages the tether 50 to the bracket means 40 at any selected location along the length of the tether 52. As seen best in FIG. 4, the tether lenght adjusting means 52 includes a tether engaging means 54 such as an aperture formed in the horizontal flange 46 of the mounting bracket 40 for engaging the tether 50 at any location along the length of the tether 50. As shown, the aperture is in the general shape of a key hole such that the tether 50 can be received freely through the head portion thereof and is tightly engaged by the slotted portion thereof. The tether length adjusting means 52 also includes a pulley 56 rotatably mounted on the vertical flange 44 of the mounting bracket 38 above the horizontal flange 46. The tether 50 is rounded to at least partially pass over the perimeter of the pulley 56 between the attachment of the tether 50 to the housing back wall 16 and the aperture 54 in the horizontal mounting bracker flange 46. The pulley 56 functions to position the length of tether 50 between the pulley 56 and the housing back wall 16, and therefore the clock face 28 at less of an acute angle to the housing back wall 16 than it would otherwise be without the pulley 56.

Figure 5:
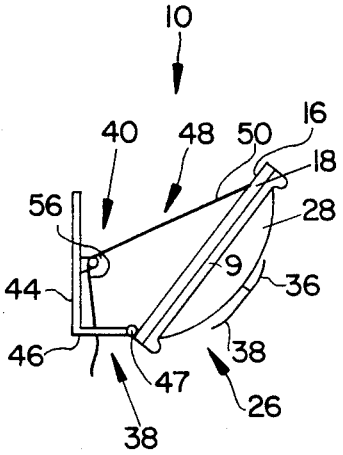
FIG. 5 is a side view of the clock security device of FIG. 1 in another postion relative to the wall upon which it is mounted.
Figure 6:
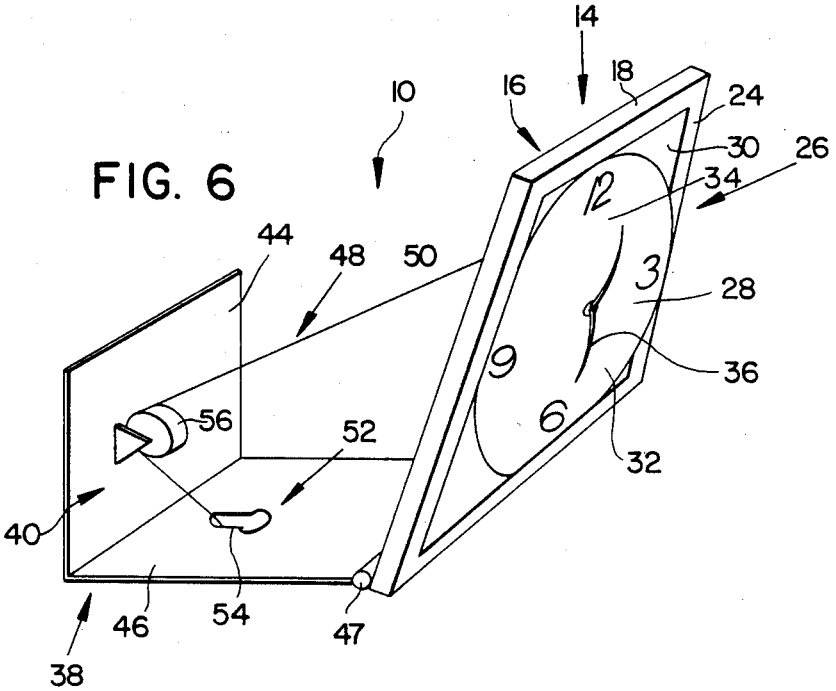
FIG. 6 is a perspective exploded view of the clock security deivce of FIG. 1.
Figure 7:
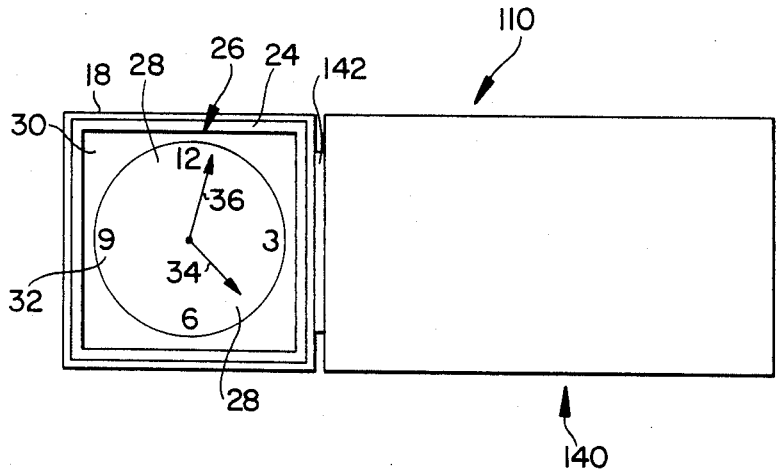
FIG. 7 is a front view of another embodiment of the clock security device of the present invention.
Figure 8:
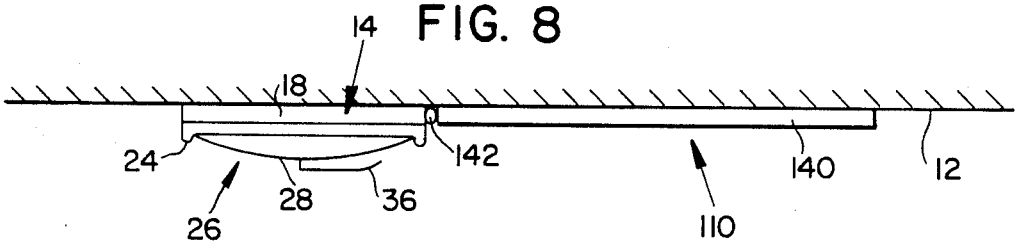
FIG. 8 is a top view of the clock security device of FIG. 7 with the clock in one position; and, FIG. 9 is a top view of the clock security device of FIG. 7 with the clock in another position.
Figure 9:
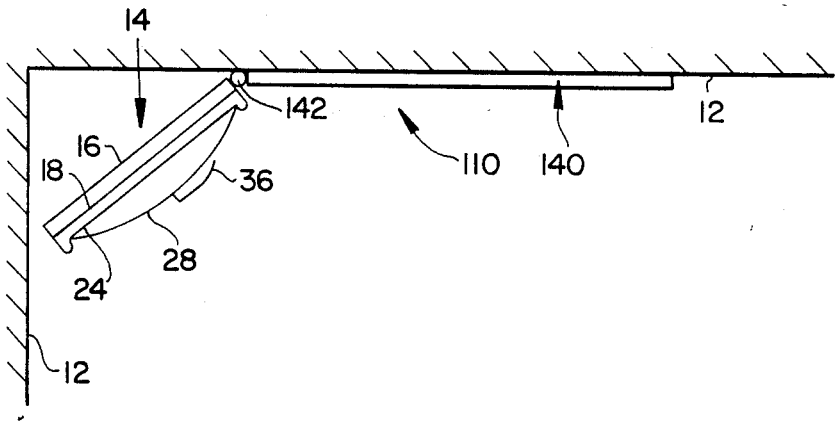

Now with reference to FIGS. 5–7, there is shown another embodiment of a clock security device, generally denoted as the numeral 110, of the present invention, which includes the above discussed clock having the convex clock face 28 for reflecting a panoramic field of view, and a wall mounting bracket panel 140. The wall mounting bracket 140 is a planar panel and is pivotally attached at one of its end edges to one side of the housing 14 of the clock by pivot means 142 such as a hinge. Indicia or decorations can be placed on the mounting bracket panel 140. The mounting bracker panel 140 is positioned flat against the wall 12 and attached thereto by virtually any convenient fastener, such as screws, so that the clock is freely pivotal about the hinge 142 to provide for changing the horizontal field of view reflected in the convex clock face 28. It should be noted here that the feature of the clock being freely pivotal relative to the mounting panel 140 provides for the mounting panel 140 being affixed to one of two intersecting walls next to the corner formed by the walls with the clock at an angle to the mounting panel 140 so that the clock extends diagonally across the corner of the intersecting walls (see FIG. 7).

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appendend claims.

What is claimed is:

1. A clock security device to be hung on a wall of a facility, comprising:

a clock having a convex mirrored face for reflecting a panorama view of the facility in which the clock security device is installed; and, means for mounting the device on the wall with the convex mirrored surface at different selected positions relative to the wall through a vertical arc parallwe to the wall and tilted downwardly at different selected included angles to the wall to change the vertical field of view reflected by the convex clock face.

2. The clock security device of claim 1, wherein the mounting means comprises:

a wall mounting bracker for attachment to the wall; means for pivotally connecting the bottom end of the closk face to the wall mounting bracket; and, means for adjustably interconnecting the clock face to the wall mounting bracket at different selected downwardly tilted angles about the pivot axis of the pivot means.

3. The clock security device of claim 2, wherein the adjustable interconnecting means comprises tether means having one end structurally associated with the back side of the clock face and structurally associated at its other end with the wall mounting bracketf and, means for adjusting the length of the tether extending between the wall mounting means and back side of the clock face.

4. The clock security device of claim 3, wherein the tether length adjusting means comprises:

means for selectively engaging the tether to the bracket means at any selected location along the length of the tether.

5. The clock security device of claim 4, wherein the tether engaging means of the wall bracker comprises an aperture formed in the bracket for engaging the tether at any preselected location along the length of the tether.

6. the clock security device of claim 5, wherein the means for adjusting the length of the tether comprises a pulley rotatably mounted to the wall bracket, and the tether at least partially passing over the perimeter of the pulley between the attachment of the tether means to the clock and the tether engaging means of the wall bracket.

7. A clock security device to be hung on a wall of a facility, comprising:

a closk having a convex mirrored face for reflecting a panoramic view of the facility in which the clock security device is installed;

a planar mounting bracket located with one of its end edges adjacent one side of the clock; and, pivot means interconnecting the end edge of the planar mounting bracket to the adjacent side of the clock so that the clock can be moved through a horizontal arc relative to the planar mounting bracket to change the horizontal field of view reflected by the convex clock face.

* * * * *